US007721726B2

(12) United States Patent
Lee et al.

(10) Patent No.: US 7,721,726 B2
(45) Date of Patent: May 25, 2010

(54) GAS RADIATION BURNER

(75) Inventors: Dae Rae Lee, Gimhae-Si (KR); Jung Wan Ryu, Changwon-Si (KR); Dae Bong Yang, Jinhae-Si (KR); Young Soo Kim, Changwon-Si (KR); Yang Ho Kim, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/648,689

(22) Filed: Jan. 3, 2007

(65) Prior Publication Data

US 2008/0008974 A1 Jan. 10, 2008

(30) Foreign Application Priority Data

Jan. 3, 2006 (KR) ..... 10-2006-0000555
Feb. 6, 2006 (KR) ..... 10-2006-0011289

(51) Int. Cl.
*F24C 3/00* (2006.01)

(52) U.S. Cl. ..... 126/39 H; 431/326; 431/327; 431/328; 431/329; 126/39 K

(58) Field of Classification Search ..... 126/39 H, 126/39 J, 39 K, 39 N; 431/12, 326, 327, 431/328, 329
See application file for complete search history.

(56) References Cited

U.S. PATENT DOCUMENTS 1,589,426 A * 6/1926 Reinecke ..... 239/567
1,839,366 A * 1/1932 Alig ..... 239/559
2,870,828 A * 1/1959 Hess ..... 126/39 H
2,991,783 A * 7/1961 Saponara ..... 126/214 R
3,028,909 A * 4/1962 Faure ..... 431/53
3,219,098 A * 11/1965 Fulmer ..... 431/349
3,329,416 A * 7/1967 Jackson ..... 432/46
3,437,085 A * 4/1969 Perry ..... 126/21 A
3,477,798 A * 11/1969 Erickson ..... 431/263
3,485,566 A * 12/1969 Schoppe ..... 431/158
3,589,620 A * 6/1971 Davis et al. ..... 239/434
3,606,612 A * 9/1971 Reid, Jr. ..... 431/281
3,763,847 A * 10/1973 Guzdar et al. ..... 126/92 B
3,777,985 A * 12/1973 Hughes et al. ..... 239/555
3,804,578 A * 4/1974 Robbins ..... 431/158
3,843,313 A * 10/1974 Helgeson ..... 431/329

(Continued)

FOREIGN PATENT DOCUMENTS

CN 1547923 A 11/2004

(Continued)

*Primary Examiner*—Kenneth B Rinehart
*Assistant Examiner*—Jorge Pereiro
(74) *Attorney, Agent, or Firm*—Birch, Stewart, Kolacsh & Birch, LLP

(57) ABSTRACT

A gas radiation burner includes a gas supply member for injecting a gas; at least one mixing pipe producing a mixed gas by sucking air together with the gas injected by the gas supply member, the at least one mixing pipe uniformly injecting the mixed gas; a burner pot having a lateral side opening connected to the at least one mixing pipe to accommodate the mixed gas supplied by the at least one mixing pipe; a burner mat provided over the burner pot to emit radiant heat generated by combustion of the mixed gas supplied by the burner pot; and a burner housing provided on the burner mat to provide a combustion room.

22 Claims, 12 Drawing Sheets

U.S. PATENT DOCUMENTS

| | | | | | |
|---|---|---|---|---|---|
| 4,083,355 | A | * | 4/1978 | Schwank | 126/39 J |
| 4,141,701 | A | * | 2/1979 | Ewan et al. | 95/217 |
| 4,201,184 | A | * | 5/1980 | Scheidler et al. | 126/39 J |
| 4,580,550 | A | * | 4/1986 | Kristen et al. | 126/39 J |
| 5,024,209 | A | * | 6/1991 | Schaupert | 126/39 H |
| 5,090,899 | A | * | 2/1992 | Kee | 431/326 |
| 5,139,007 | A | * | 8/1992 | Bertomeu Martinez | 126/39 J |
| 5,197,872 | A | * | 3/1993 | Bertomeu Martinez | 431/284 |
| 5,209,187 | A | * | 5/1993 | Khinkis | 122/136 R |
| 5,408,984 | A | * | 4/1995 | Maughan | 126/39 E |
| 5,509,403 | A | * | 4/1996 | Kahlke et al. | 126/39 E |
| 5,596,873 | A | * | 1/1997 | Joshi et al. | 60/738 |
| 5,816,235 | A | * | 10/1998 | Kim et al. | 126/39 H |
| 5,993,192 | A | * | 11/1999 | Schmidt et al. | 431/7 |
| 6,076,517 | A | * | 6/2000 | Kahlke et al. | 126/39 J |
| 6,230,701 | B1 | * | 5/2001 | Schultheis et al. | 126/39 J |
| 2002/0164553 | A1 | * | 11/2002 | Distaso et al. | 431/280 |
| 2006/0076005 | A1 | * | 4/2006 | Kim et al. | 126/214 R |
| 2006/0078836 | A1 | * | 4/2006 | Kim et al. | 431/12 |
| 2007/0202451 | A1 | * | 8/2007 | Lee et al. | 431/326 |
| 2007/0207430 | A1 | * | 9/2007 | Lee et al. | 431/328 |

FOREIGN PATENT DOCUMENTS

| | | | | |
|---|---|---|---|---|
| CN | 1590844 | A | | 3/2005 |
| DE | 3811477 | A1 | * | 10/1988 |
| EP | 0469251 | A1 | | 2/1992 |
| JP | 2-37205 | A | | 2/1990 |
| JP | 07-055117 | | | 3/1995 |
| JP | 8-28827 | A | | 2/1996 |
| JP | 9-178126 | A | | 7/1997 |
| JP | 09178126 | A | * | 7/1997 |
| JP | 11141814 | A | * | 5/1999 |
| JP | 2002-206746 | | | 7/2002 |
| JP | 2005156099 | A | * | 6/2005 |
| KR | 10-1998-0701402 | | | 5/1998 |
| KR | 20-1999-0041033 | | | 12/1999 |
| KR | 1999-0041033 | U | | 12/1999 |
| KR | 2001-0102247 | A | | 11/2001 |
| KR | 10-0531326 | B1 | | 12/2004 |
| KR | 10-2005-003694 | A | | 1/2005 |
| KR | 10-0522435 | B1 | | 1/2005 |
| KR | 10-2005-0097715 | | | 10/2005 |

* cited by examiner

GAS RADIATION BURNER

This Nonprovisional application claims priority under 35 U.S.C. §119(a) on Patent Application No. 10-2006-0000555 filed in Korea on Jan. 3, 2006 and Patent Application No. 10-2006-0011289 filed in Korea on Feb. 6, 2006, the entire contents of which are hereby incorporated by reference.

BACKGROUND OF THE INVENTION

1. Field of the Invention

The present invention relates to a gas radiation burner. Although the present invention is suitable for a wide scope of applications, it is particularly suitable for supplying a mixed gas uniformly and accelerating combustion of the gas.

2. Discussion of the Related Art

Generally, a gas radiation burner provided to a gas oven or range is a device for cooking in a manner of heating an object by radiant waves generated from a radiant body that is heated as a mixed gas burns. This mixed gas includes gas and air.

In particular, since a glass is placed over the gas radiation burner, the glass can prevent the flame from being externally exposed. Therefore, a fire can be prevented. In addition, the gas radiation burner facilitates cleaning to enhance its convenience for use.

An example of a gas radiation burner 10 according to a related art is explained in detail with reference to FIG. 1 and FIG. 2 as follows. FIG. 1 is a schematic layout of a gas radiation burner according to a related art and FIG. 2 is a cross-sectional diagram of the gas radiation burner along a cutting line II-II shown in FIG. 1. Referring to FIG. 1 and FIG. 2, a gas radiation burner according to a related art mainly includes a mixing pipe 2, a burner pot 4, a burner mat 6, a burner housing 8 and a glass 10.

The mixing pipe 2 provides a space into which a gas fuel and air are introduced to be primarily mixed. In this case, the gas fuel is sprayed from a nozzle 1 that configures a gas supply member. In addition, the air is introduced into the mixing pipe 2 by a spray pressure of the gas fuel to be mixed therein.

A lower portion of the burner pot 4 is connected to the mixing pipe 2 to provide a space, into which the mixed gas supplied from the mixing pipe 2 is introduced therein.

The burner mat 6 is mounted on a mounting part 5 provided over the burner pot 2. The burner mat 6 plays a role as a radiant body that generates radiant waves when the mixed gas introduced into the burner pot 4 burns.

The burner housing 8 plays a role as a body of the gas radiation burner. The burner pot 4 is locked to the burner housing 8. An object to be heated is placed on the burner housing 8. In this case, the burner housing 8 is provided with a circular opening 9 through which the radiant energy emitted from the burner mat 6 passes.

The glass 10 is placed on the burner housing 8. The object to be heated is placed onto the glass 10. Besides, an outlet 11 is provided within the burner housing 8. Therefore, an exhaust gas produced from burning the mixed gas is discharged via the outlet 11.

An operation of the above-configured gas radiation burner is explained as follows. First of all, a user puts an object to be heated onto the glass 10 and then activates the gas radiation burner. Subsequently, a gas fuel and air are introduced into the mixing pipe 2 respectively. The introduced gas fuel and air are supplied to the burner pot 5 and mixed together. The mixed gas is then sprayed via the burner mat 6.

Simultaneously, the mixed gas is ignited by a prescribed ignition device (not shown in the drawings) and is then burnt on the burner mat 6. As the mixed gas is burnt, the burner mat 6 is heated to emit radiant energy. Therefore, the object put on the glass 10 is heated by the generated radiant energy. In this case, an exhaust gas generated from the combustion of the mixed gas at about 500° C. or higher is discharged via the outlet 11 provided within the burner housing 8.

However, the related art gas radiation burner has the following problems.

First of all, since the mixing pipe 2 of the conventional gas radiation burner is connected to the lower portion of the burner pot 4, the entire gas radiation burner is thick and would be difficult to make the gas radiation burner structurally compact.

Secondly, in the related art gas radiation burner, since the gas and air are supplied via the mixing pipe 2 provided to one side of the gas radiation burner and are mixed with each other within the burner pot 4, a mixed rate between the gas and air is deflectively and non-uniformly distributed within the burner pot 4. Therefore, incomplete combustion takes place locally, whereby irregular combustion takes place on a surface of the burner mat 6. The irregular surface combustion reduces combustion efficiency, increases the amount of a discharge gas, and lowers heat efficiency of the gas radiation burner.

Thirdly, the burner mat 6 is formed of a ceramic-based material in general. Since a temperature for sustaining durability is low due to properties of the ceramic-based material, the corresponding durability of the burner mat 6 is low.

Fourthly, the burner mat 6 has difficulty in generating a large amount of heat, thereby reducing efficiency. In particular, since it is better to keep a temperature of the ceramic-based burner mat 6 low to extend its life span due to the material properties of the burner mat 6, it is difficult to raise the temperature over a prescribed temperature. Hence, it further limits the amount of heat generated on the burner mat 6.

Fifthly, the ceramic-based burner mat 6 has low thermal conductivity due to the properties of the ceramic-based material. Since it takes longer to accumulate heat, radiant efficiency of the burner mat 6 is low.

Finally, since gas and air are mixed together in the burner pot 4 of the related art gas radiation burner, the burner pot 4 should be provided with a sufficient internal space to well mix the gas and air. Therefore, it is difficult to reduce the size of the burner pot 4. In particular, if a height of the burner pot 4 is lowered, the flow resistance of the gas and air is increased within the burner pot 4. Therefore, the gas and air cannot be well mixed together if a height of the burner pot 4 is lowered.

SUMMARY OF THE INVENTION

Accordingly, the present invention is directed to a gas radiation burner that substantially obviates one or more problems due to limitations and disadvantages of the related art.

An object of the present invention is to provide a gas radiation burner, by which a well mixed gas is uniformly supplied to a burner pot of the gas radiation burner.

Another object of the present invention is to provide a gas radiation burner, by which combustion is accelerated on a surface of a burner mat.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a gas radiation burner includes a gas supply member for injecting a gas; at least one mixing pipe producing a mixed gas by sucking air together with the gas injected by the gas supply member, the at least one mixing pipe uniformly injecting the mixed gas; a burner pot having a lateral side opening connected to the at least one mixing pipe to accommodate the mixed gas supplied by the at least one mixing pipe; a burner mat provided over the burner pot to emit radiant heat generated by combustion of the mixed gas supplied by the burner pot; and a burner housing provided on the burner mat to provide a combustion room.

In another aspect of the present invention, a gas radiation burner includes a gas supply member for injecting a gas; at least one mixing pipe sucking to supply air together with the gas injected by the gas supply member; a burner pot accommodating to supply a mixed gas supplied by the at least one mixing pipe; a burner mat provided over the burner pot to emit radiant heat generated by combustion of the mixed gas supplied by the burner pot; a burner housing provided on the burner mat to provide a combustion room; and combustion accelerating means for accelerating the combustion on the burner mat.

In a further aspect of the present invention, a gas radiation burner includes a gas supply member for injecting a gas; at least one mixing pipe producing a mixed gas by sucking air together with the gas injected by the gas supply member, the at least one mixing pipe having a widening pipe shape to uniformly supply the mixed gas; a burner pot having a lateral side opening connected to the mixing pipe to accommodate the mixed gas; a burner mat provided over the burner pot to emit radiant heat generated by combustion of the mixed gas supplied by the burner pot; a burner housing provided on the burner mat to provide a combustion room; and combustion accelerating means for accelerating the combustion on the burner mat.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
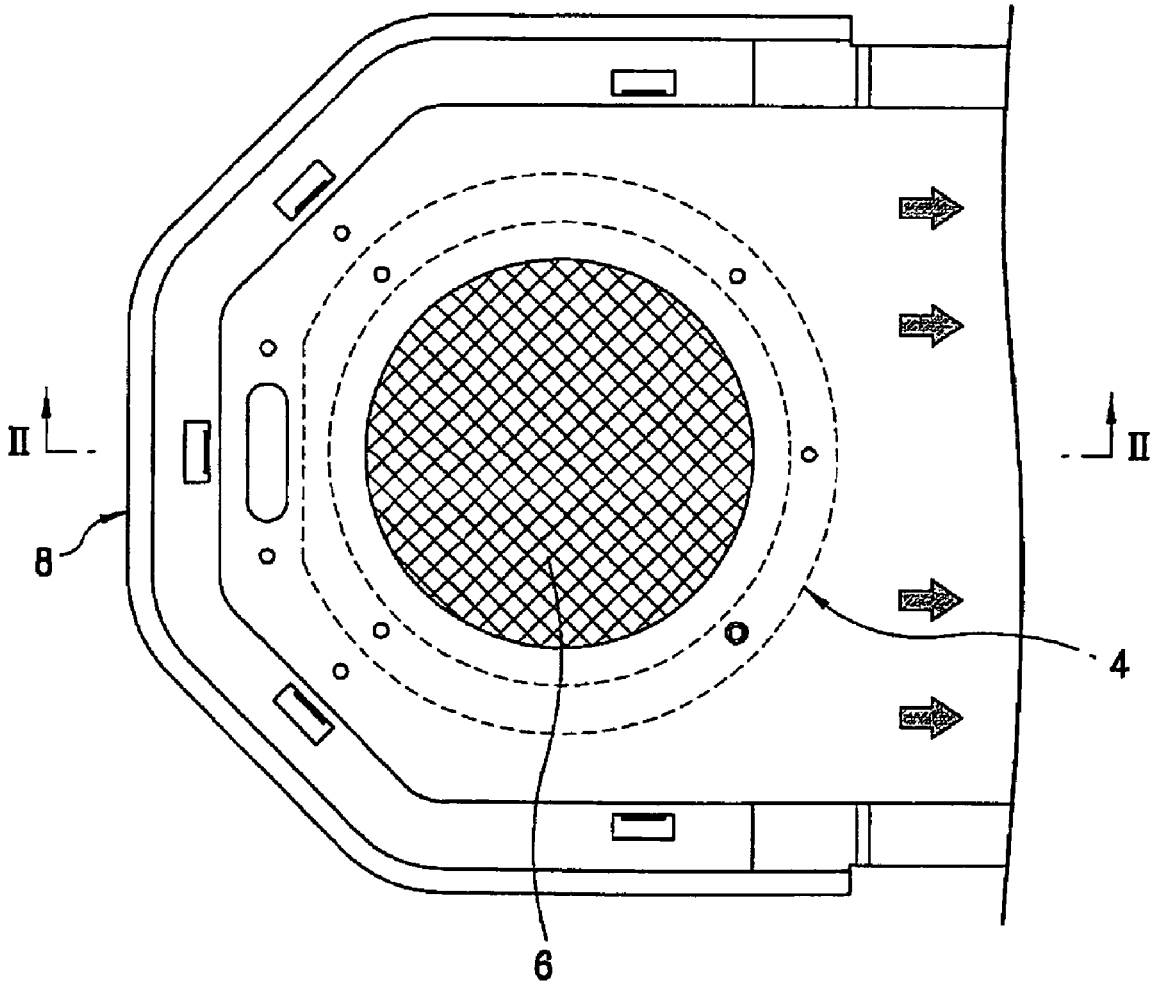
FIG. 1 is a schematic layout of a gas radiation burner according to a related art.
Figure 2:
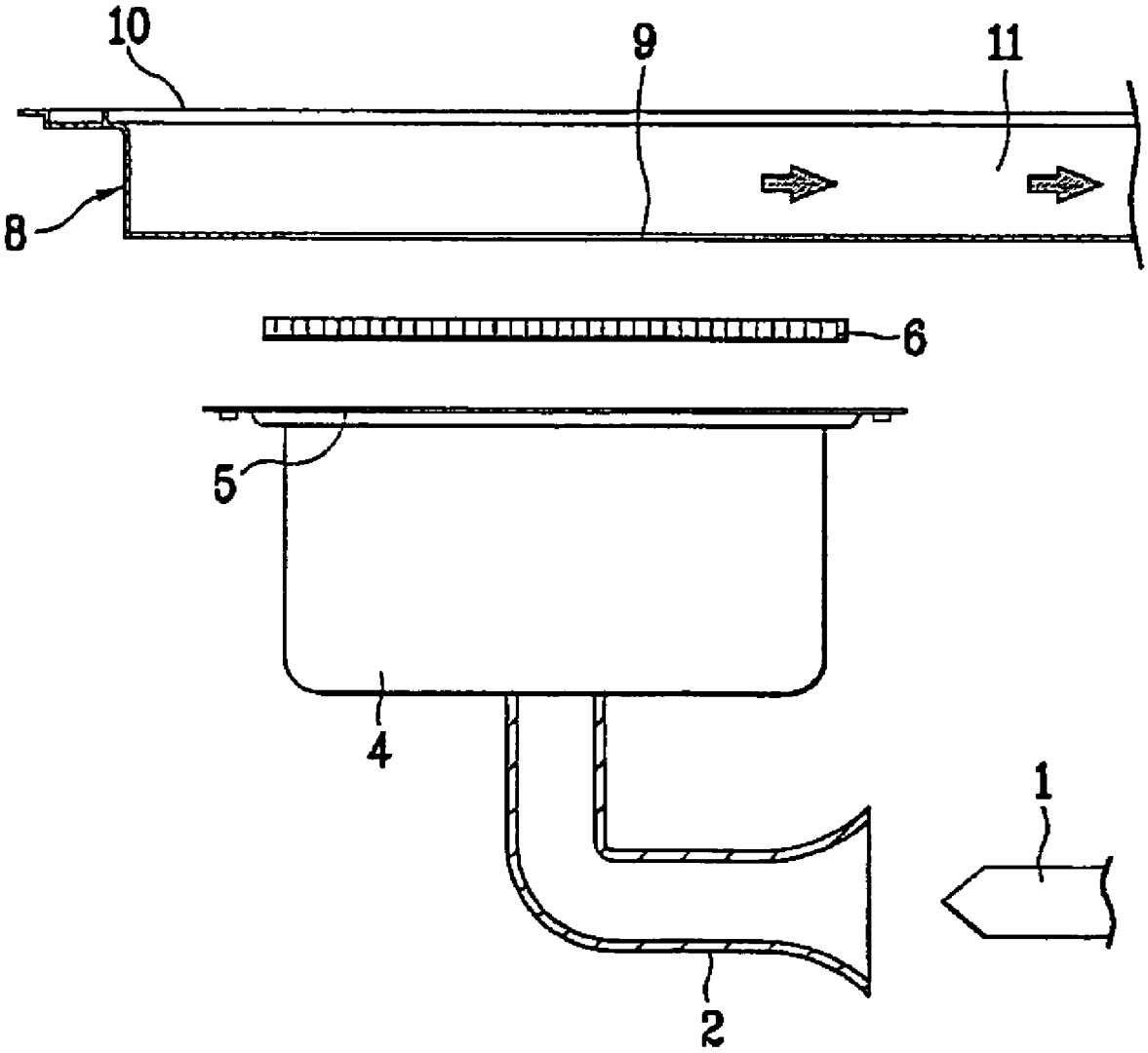
FIG. 2 is a cross-sectional diagram of the gas radiation burner along a cutting line II-II shown in FIG. 1.
Figure 3:
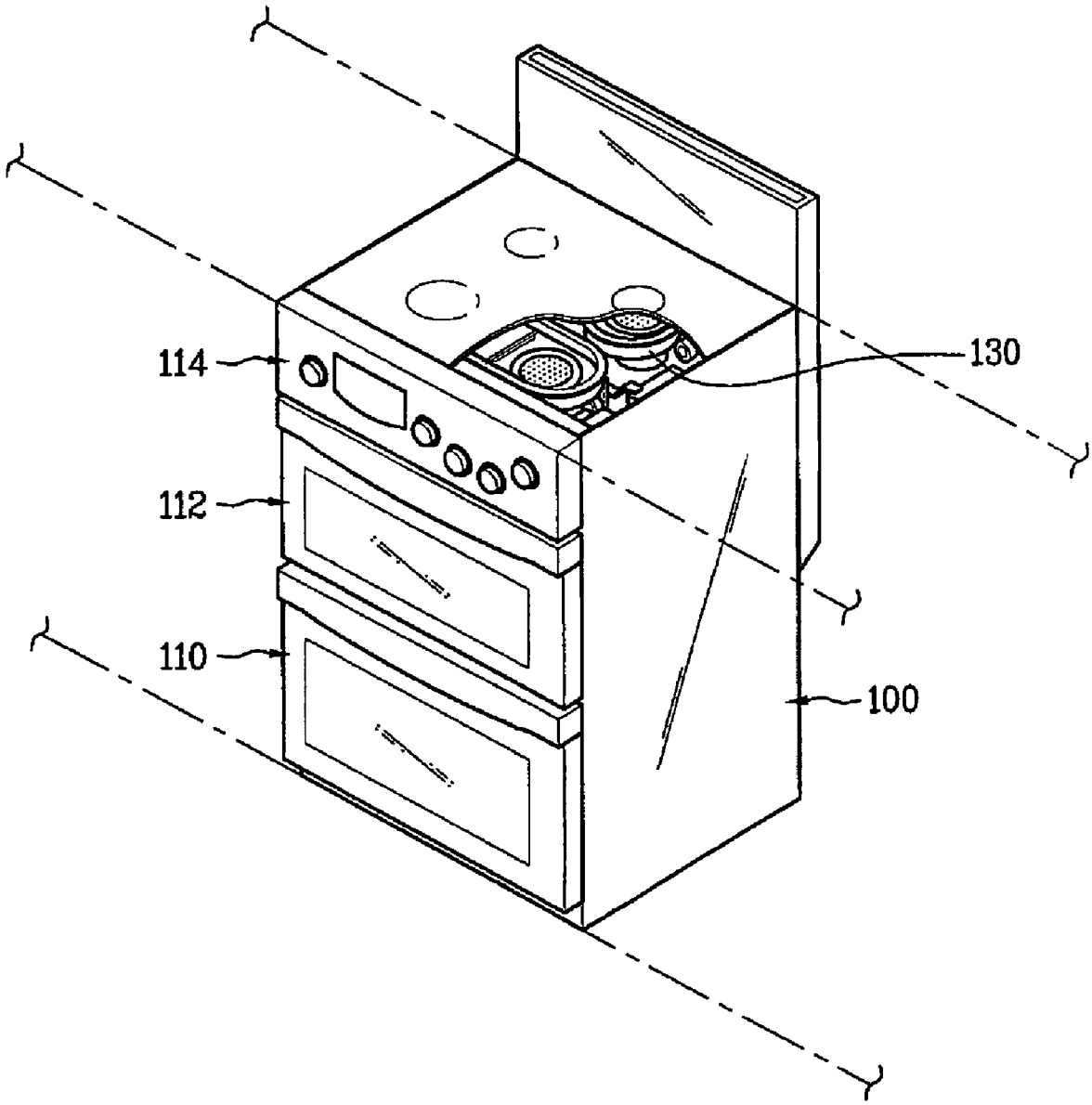
FIG. 3 is a perspective diagram of a gas oven or range provided with a gas radiation burner according to a preferred embodiment of the present invention.

First of all, a gas oven or range employing a gas radiation burner according to an embodiment of the present invention is explained with reference to FIG. 3. In addition, FIG. 3 shows an example of a built-in type gas oven or range. Referring to FIG. 3, a gas oven or range includes a body 100, an oven part 110, a grill part 112 and a top burner part 114 including a plurality of gas radiation burners 130.

The body 100 configures an exterior of the gas oven or range. The oven part 110 is provided to a lower part of the body 100 and configures a space for cooking food by convection using a plurality of heaters (not shown in the drawing) provided within the oven part 110. The grill part 112 configures a space for cooking food such as fish, meat and the like using radiant heat.

A plurality of gas radiation burners 130 are provided to an upper part of the body 100 to cook food by heating a container accommodating the food therein. In addition, a glass (134 in FIG. 5) formed of a ceramic-based material is provided to an opening over the corresponding gas radiation burner 130.

Figure 4:
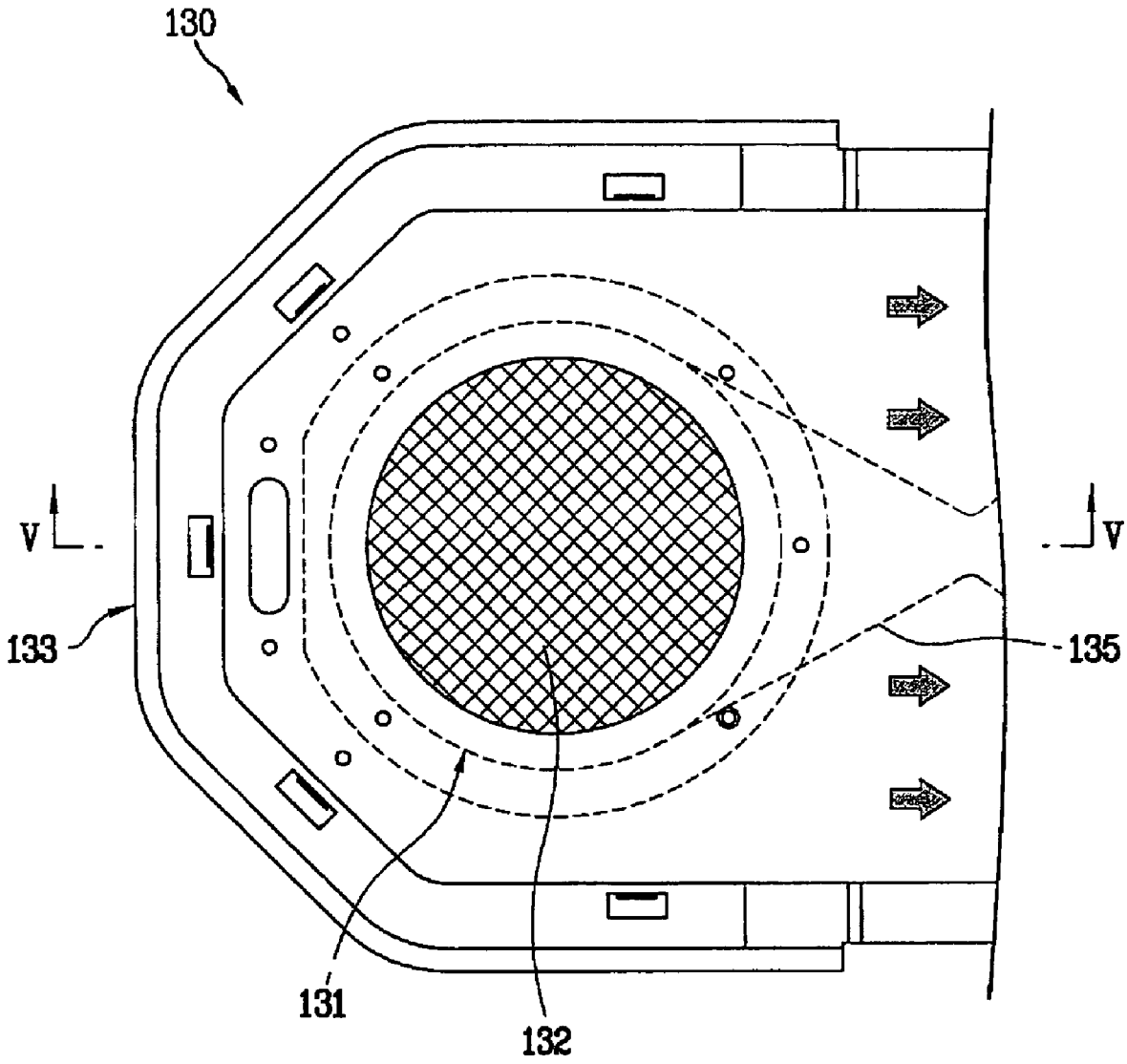
FIG. 4 is a layout of a gas radiation burner according to a first preferred embodiment of the present invention.
Figure 5:
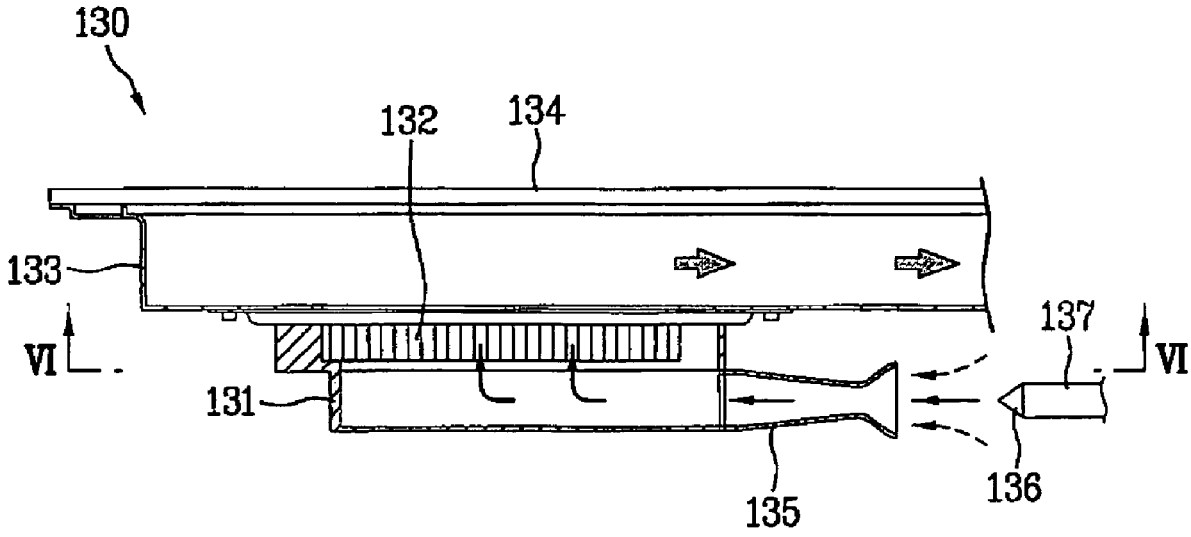
FIG. 5 is a cross-sectional diagram along a cutting line V-V shown in FIG. 4.

FIG. 4 is a layout of a gas radiation burner according to a first preferred embodiment of the present invention adopted by the gas oven or range shown in FIG. 3. FIG. 5 is a cross-sectional diagram along a cutting line V-V shown in FIG. 4. Referring to FIG. 4 and FIG. 5, a gas radiation burner 130 includes a mixing pipe 135 into which air and a fuel gas injected via a gas supply pipe 137 and a nozzle 136 are introduced, a burner pot 131 supplied with a mixed gas from the mixing pipe 135, a burner mat 131 emitting radiant heat by a combustion of the mixed gas supplied by the burner pot 131, a burner housing 133 configuring a combustion room, and a glass 134 provided over the burner housing 133.

The above-configured gas radiation burner 130 according to the first embodiment of the present invention differs from the related art gas radiation burner in a configuration of the mixing pipe 135. In the following description, the mixing pipe 135 is mainly explained.

In accordance with this embodiment of the present invention, the mixing pipe 135 is connected to a lateral side of the burner pot 131 to supply the mixed gas into the burner pot 131. Thus, the thickness of the gas radiation burner of this illustrated embodiment can be reduced remarkably, compared with the conventional structure in which a mixing pipe is connected to a lower portion of the burner pot.

Figure 6:
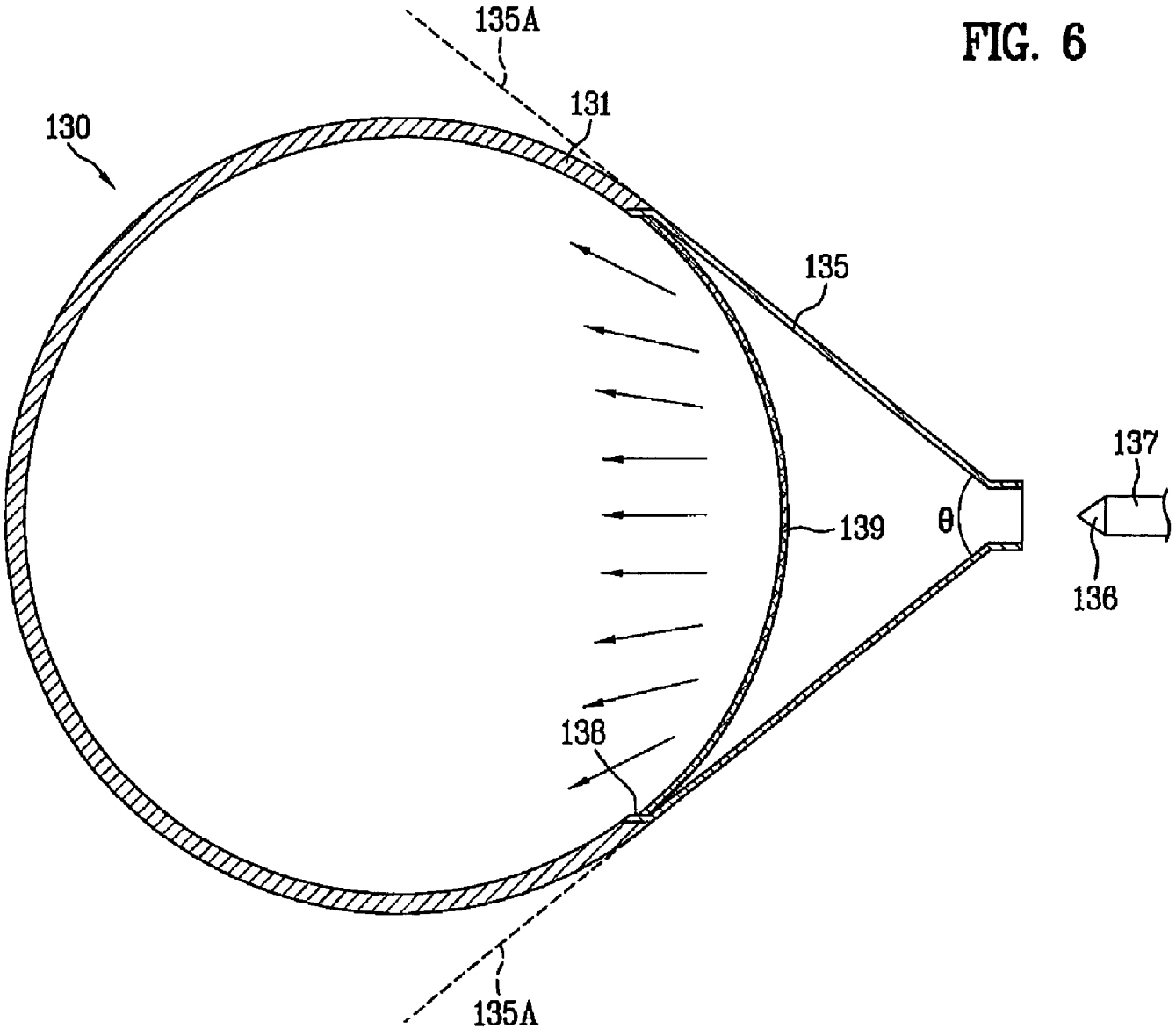
FIG. 6 is a cross-sectional diagram along a cutting line VI-VI shown in FIG. 5.

FIG. 6 is a cross-sectional diagram along a cutting line VI-VI shown in FIG. 5, in which the mixing pipe 135 of the gas radiation burner according to the first embodiment of the present invention is shown in detail. Referring to FIG. 6, the mixing pipe 135 is provided to one lateral side of the burner pot 131. The mixing pipe 135 is configured to have an exit side in a widening pipe shape. Namely, an exit side of the mixing pipe 135 is wider than an entrance side of the mixing pipe 135. In particular, the extension lines 135A extending from both sides of an exit of the mixing pipe 135 are configured to enclose a whole cross-section of the burner pot 131. Therefore, the mixing pipe 135 is configured to come into contact with an outer circumference of the burner pot 131 having a circular cross-section.

Since the mixing pipe 135 is provided with a wide exit angle θ, it is very effective in securing a massive amount of combustion air. In addition, as shown in FIG. 6, the extension lines 135A are tangent to the outer circumference of the burner pot 131 and the tangent points are at the two ends of the opening at the lateral side of the burner pot 131. Since the mixing pipe 135 communicates with the burner pot 131 with a wide area, it is able to inject a mixed gas from a lateral side of the burner pot 131. Therefore, the mixing pipe 131 is very advantageous in uniformly distributing mixed gas within the burner pot 131.

A mesh 139 is provided to a connecting portion of the burner pot 131 connected to the mixing pipe 135 to recover a pressure by reducing a speed of the mixed gas injected from the mixing pipe 135. The mesh 139 recovers the pressure by reducing the speed of the mixed gas into a prescribed level, thereby uniformly distributing the mixed gas within the burner pot 131 and enabling uniform surface combustion to proceed across the entire gas radiation burner.

Figure 7:
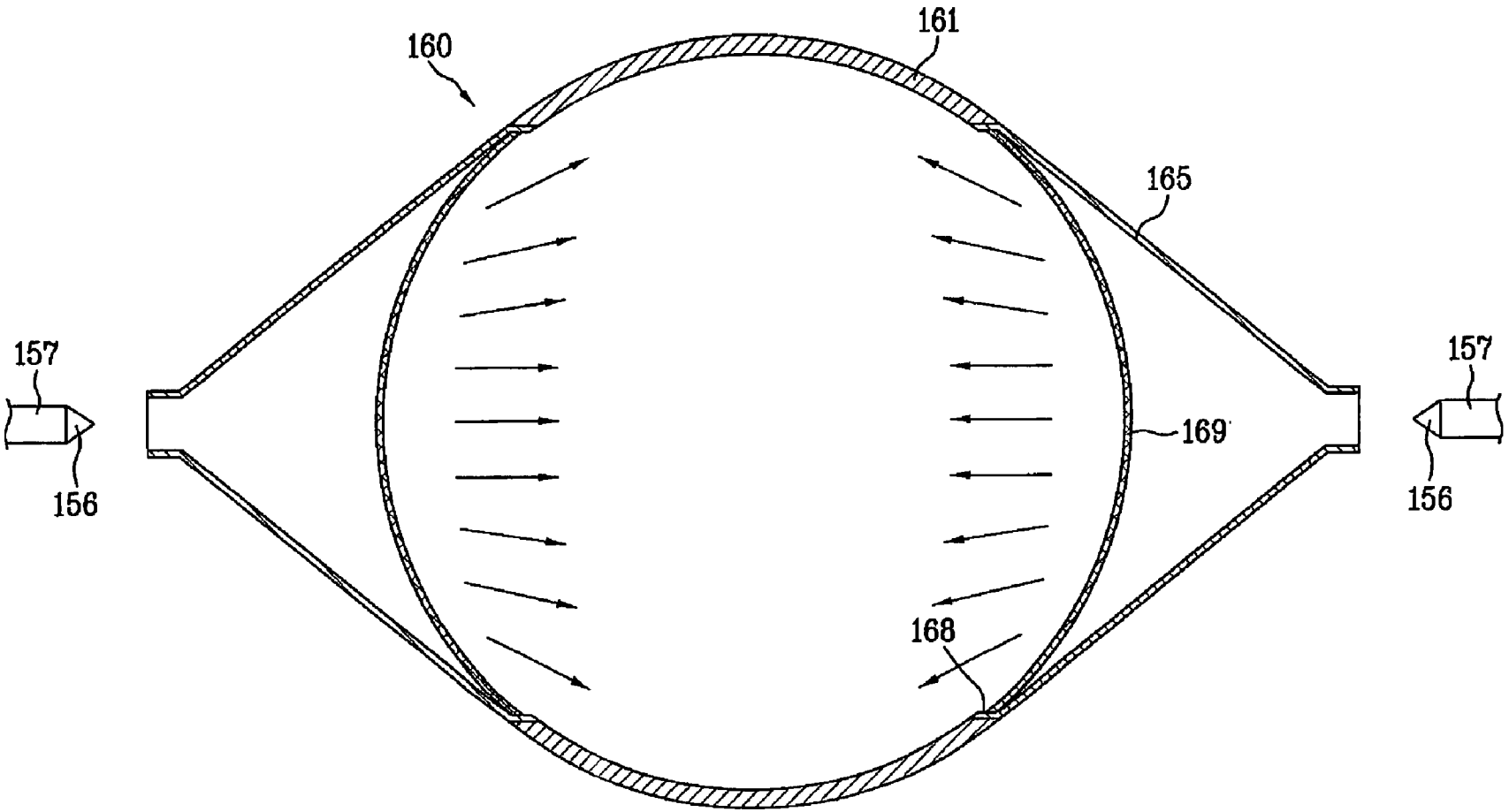
FIG. 7 is a cross-sectional diagram of a gas radiation burner according to a modification of the first embodiment shown in FIG. 4, in which a connected state between a burner pot and a mixing pipe is shown.

FIG. 7 is a cross-sectional diagram of a gas radiation burner according to a modification of the first embodiment shown in FIG. 4, in which a connected state between a burner pot and a mixing pipe is shown. Referring to FIG. 7, a basic configuration of the present embodiment is equivalent to that of the first embodiment but differs from that of the first embodiment in that a pair of mixing pipes 165 are provided to both lateral sides of the burner pot 161 opposite to each other.

In the present embodiment, a pair of the mixing pipes 165 having wide exit angles, respectively, to provide sufficient air for combustion and to efficiently and uniformly mix the air and the gas.

As the mixed gas is injected on both lateral sides of the burner pot 161, the mixing pipes 165 are very effective in uniformly distribute the mixed gas within the burner pot 161. In particular, as the mixed gas are mingled by the injection pressure of the mixing pipe 165 and the mixed gas flow, the mixed gas can be evenly distributed within the burner pot 161. Moreover, the mixed gas can be evenly injected on the burner mat 132.

Meanwhile, in the gas radiation burner according to the first or modified embodiment of the present invention, the gas and the air are mixed in the mixing pipe and are then supplied to the burner pot. They can be evenly distributed even if an internal space of the burner pot is small. Therefore, the height and volume of the burner pot can be significantly reduced. Hence, it is able to configure a gas radiation burner having a compact size. It is also able to install the compact-sized gas radiation burner in a built-in type gas oven or range because of the feasibility in installation.

Figure 8:
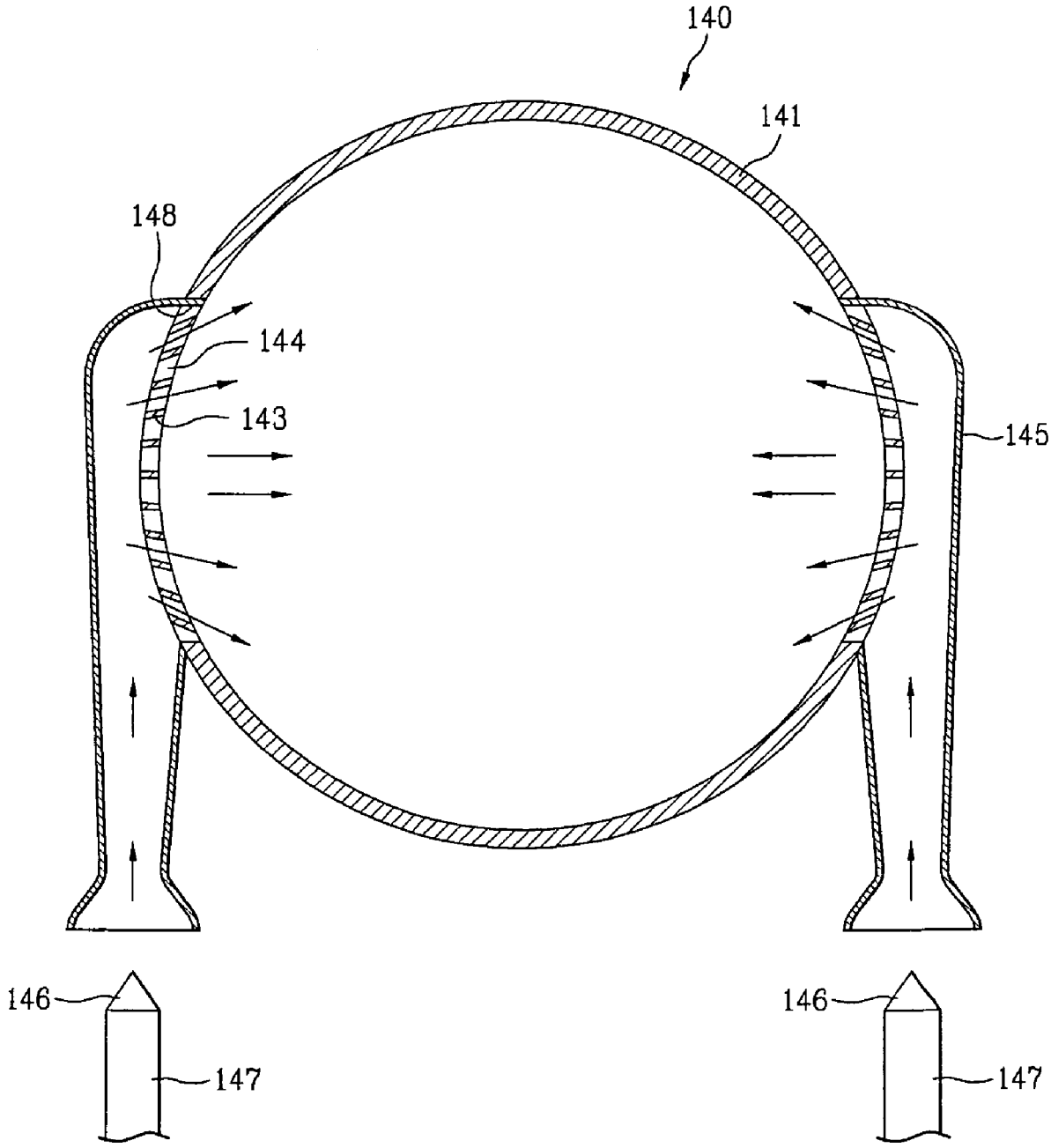
FIG. 8 is a cross-sectional diagram of a gas radiation burner according to a second embodiment of the present invention, in which a connected state between a burner pot and a mixing pipe is shown.

A gas radiation burner 140 according to a second preferred embodiment of the present invention is explained in detail with reference to FIG. 8 as follows. FIG. 8 is a cross-sectional diagram of a gas radiation burner according to a second embodiment of the present invention, in which a connected state between a burner pot and a mixing pipe is shown. A gas radiation burner 140 according to a third embodiment of the present invention differs from those of the aforesaid embodiments of the present invention in a configuration of a mixing pipe 145. The differences will be explained hereinbelow.

Referring to FIG. 8, a mixing pipe 145 of a third embodiment of the present invention is bent by a prescribed angle, e.g., 90 degrees, to be connected to each lateral side of a burner pot 141. Thus, if the mixing pipe 145 has a bent shape, a length of the mixing pipe 145 is increased so as to further mix the air and gas together within the corresponding mixing pipe 145. Therefore, as the gas and air having been sufficiently mixed together within corresponding mixing pipe 145 are supplied to the burner pot 141, it is able to prevent local flow deflection and non-uniformity of the mixed gas within the burner pot 141.

Moreover, since the mixing pipe 15, as shown in FIG. 8, is bent to be connected to the corresponding lateral side of the burner pot 141, it is able to communicate with a large area of the burner pot 141. Therefore, as the mixed gas is evenly injected on the large areas of the lateral sides of the burner pot 141, it is advantageous in uniformly distribute the mixed gas within the burner pot 141.

In particular, if the mixing pipe 145, as shown in FIG. 8, is bent to be installed along the lateral side of the burner pot 141, it is able to minimize a portion projected from the burner pot 141 while a length for mixing the gas and air along the internal space of the mixing pipe 145 is increased. Therefore, it is able to configure a compact size of a gas radiation burner by reducing an overall volume of the gas radiation burner.

Optionally, a direction adjusting member 143 can be provided to a connecting portion 148, where the mixing pipe 145 is connected, of the burner pot 141. In this case the direction adjusting member 143 guides a direction of the mixed gas injected from the mixing pipe 145 to evenly inject the mixed gas into the burner pot 141. Optionally, a plurality of slots or slits 144 are provided to the direction adjusting member 143 so that the mixed gas can pass therethrough.

For instance, in order for the mixed gas to be injected at a wide injection angle from the mixing pipe 145, a plurality of slits 144, as shown in FIG. 8, are configured in a vertical direction to be externally widened from both ends of the mixing pipe 145.

Figure 9:
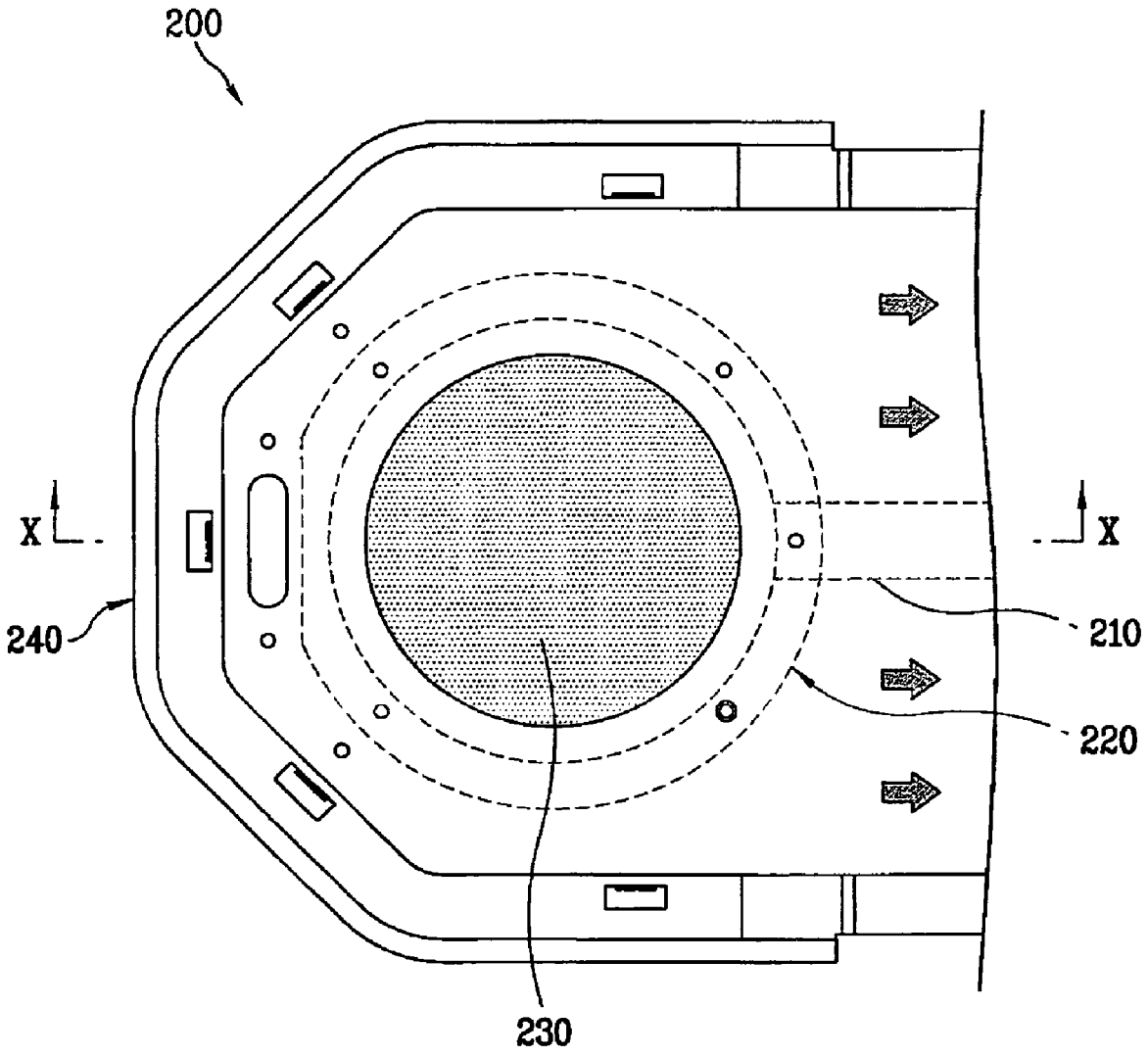
FIG. 9 is a layout of a gas radiation burner according to a third preferred embodiment of the present invention.
Figure 10:
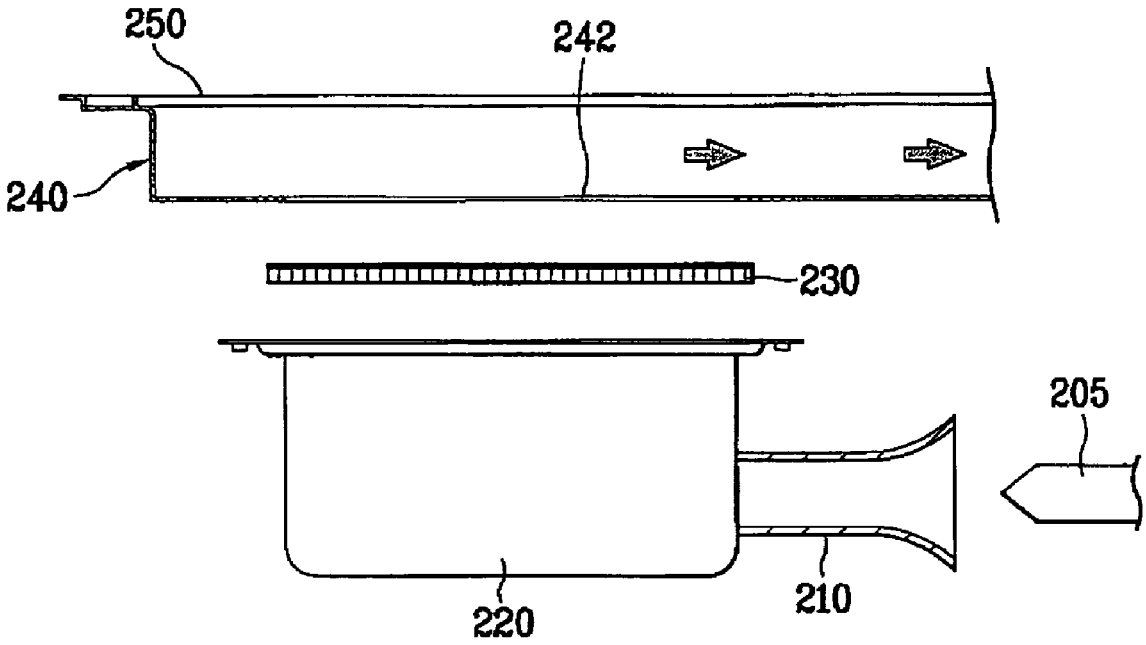
FIG. 10 is a cross-sectional diagram along a cutting line X-X shown in FIG. 9.

FIG. 9 is a layout of a gas radiation burner according to a third preferred embodiment of the present invention, and FIG. 10 is a cross-sectional diagram along a cutting line X-X shown in FIG. 9. Comparing to the aforesaid embodiments of the present invention, the third embodiment of the present invention differs in having combustion accelerating means for accelerating combustion in a burner mat. The differences are explained hereinbelow.

Referring to FIG. 9 and FIG. 10, a gas radiation burner 200 according to a third embodiment of the present invention includes a burner mat 230 provided with a catalyzing agent capable of reforming a mixed gas catalytically. The burner mat 230 provided with the catalyzing agent is explained in detail as follows.

First of all, the burner mat 230 provided with the catalyzing agent is an element for the catalytic reforming of a mixed gas introduced into a burner pot 220. In particular, the burner mat 230 provided with a catalyzing agent such as Pt, Ni and the like raises an octane value by coming into contact with a mixed gas to reform mixed gas components. Thus, as the octane value of the mixed gas is raised by the catalyzing agent, combustion of the mixed gas is accelerated on a surface of the burner mat 230. In this case, the catalyzing agent can be coated on the surface of the burner mat 230. Alternatively, the burner mat 230 can be made of the catalyzing agent.

Figure 11:
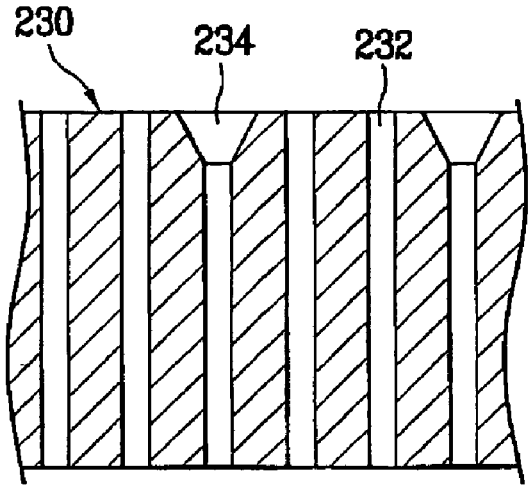
FIG. 11 is an enlarged diagram of a burner mat shown in FIG. 10.

Besides, a plurality of belching holes 232, as shown in FIG. 11, are provided to the burner mat 232 to enable a mixed gas to belch out of a lower side to an upper side. In this case, a diffusing portion 234 having an increasing end area is provided to each of the belching holes 232 to increase the belching efficiency of the mixed gas.

An operation of the above-configured gas radiation burner according to the third embodiment of the present invention is explained as follows. First of all, a mixed gas introduced into the burner pot 220 via the corresponding mixing pipe 210 belches out of the belching holes 232 of the burner mat 230.

Simultaneously, the mixed gas is ignited by ignition means (not shown in the drawings) and is then burnt on a surface of the burner mat 230. As the mixed gas is burnt to heat the burner mat 230, the heated burner mat 230 emits radiant energy to cook an object to be heated. In this case, the mixed gas belching out of the belching holes 232 of the burner mat 230 are reformed to raise the octane value, whereby combustion of the mixed gas is accelerated on the surface of the burner mat 230.

Therefore, as the combustion of the mixed gas on the surface of the burner mat 230 is accelerated, flames are stable on the burner mat 230 to improve combustion efficiency. As the combustion of the mixed gas is accelerated, the time for heating up the burner mat 230 is reduced. Therefore, it is able to quickly raise the temperature of the burner mat 230. Hence, the thermal efficiency is raised.

As the combustion of the mixed gas is accelerated, it is able to reduce an amount of carbon monoxide produced from the combustion of the mixed gas. In addition, it is able to reduce environmental pollution by enhancing properties of an exhaust gas produced from the combustion of the mixed gas.

Figure 12:
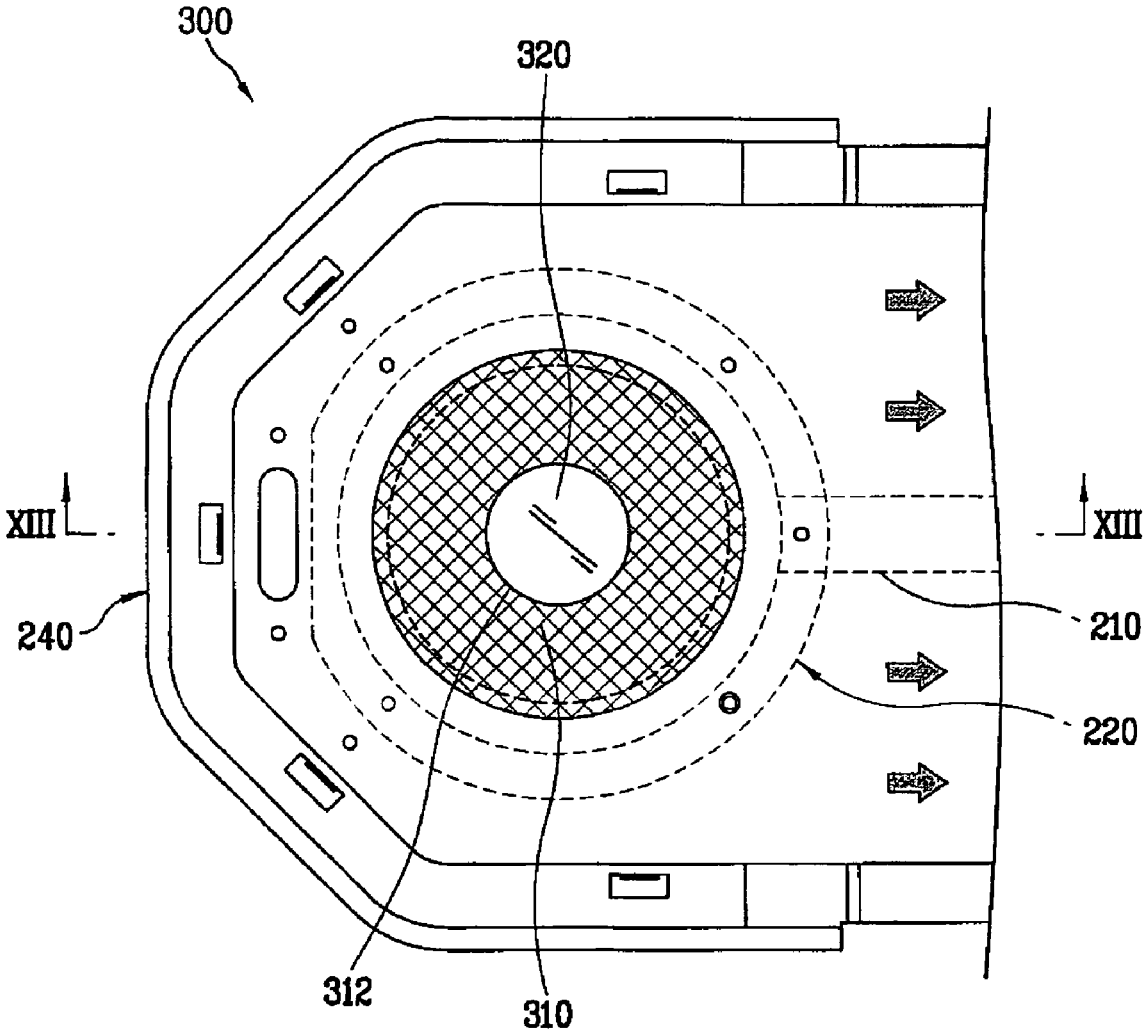
FIG. 12 is a layout of a gas radiation burner according to a fourth preferred embodiment of the present invention.
Figure 13:
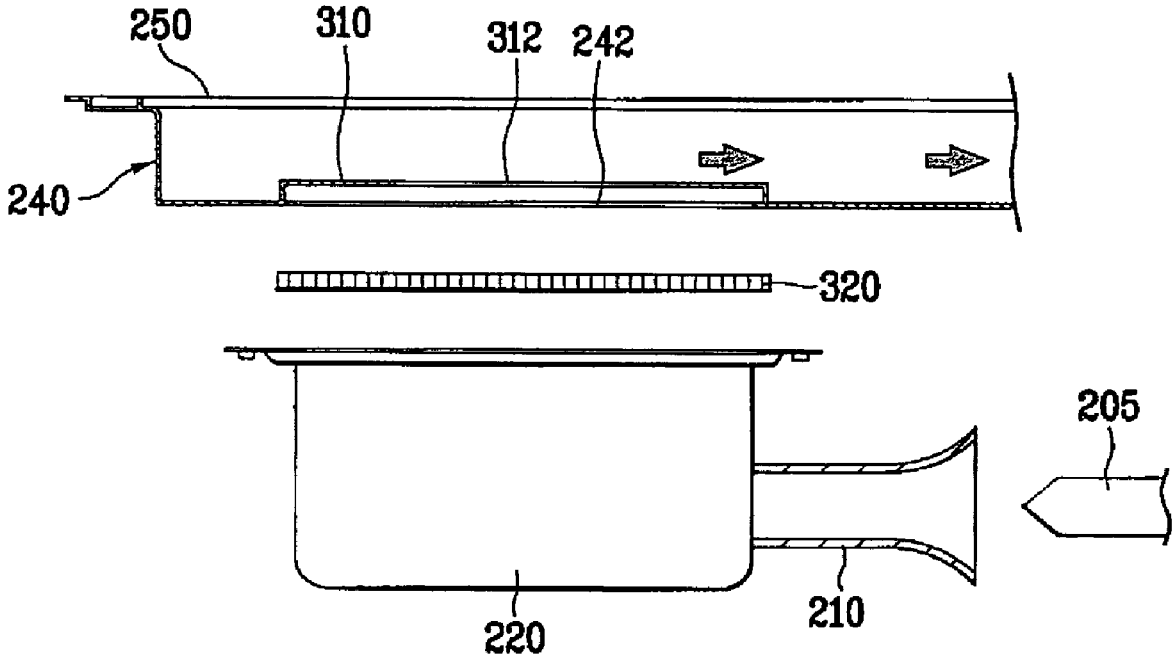
FIG. 13 is a cross-sectional diagram along a cutting line XIII-XIII shown in FIG. 12.

FIG. 12 is a layout of a gas radiation burner according to a fourth preferred embodiment of the present invention, and FIG. 13 is a cross-sectional diagram along a cutting line XIII-XIII shown in FIG. 12. Referring to FIG. 12 and FIG. 13, a gas radiation burner according to a fourth preferred embodiment of the present invention differs from those of the aforesaid embodiments of the present invention in further including a conduction member 310 accelerating combustion of a mixed gas. The conduction member 310 is explained in detail with reference to FIG. 12 and FIG. 13 as follows.

First of all, the conduction member 310 is provided over a burner mat 320 to have a shape corresponding to that of the burner mat 320. In particular, the conduction member 310 is configured to have a circular disc shape corresponding to that of the burner mat 320 and is spaced apart from a top of the burner mat 320.

Preferably, the conduction member 310 is made of a Ni—Cr alloy having high thermal conductivity. Since the burner mat 320 is normally formed of a ceramic-based material to have low thermal conductivity, radiant efficiency is low. Therefore, by using the conduction member 310 having high thermal conductivity, it is able to quickly heat up the conduction member 310 by the combustion occurring on a surface of the burner mat 320. Accordingly, heat is transferred upward and downward, i.e., to an object to be heated and the burner mat 320. Hence, it is able to accelerate the combustion of the mixed gas. It is also able to raise radiant efficiency by shortening a heating time of the burner mat 320.

Meanwhile, it is preferable that a circular perforated portion 312 is provided to a center of the conduction member 310 to prevent overheating of the burner mat 320. In particular, as the heat generated from the burner mat 320 is cut off, the conduction member 310 may still heat the burner mat 320 up, and the burner mat 320 can be overheated. To prevent the burner mat 320 from being overheated, the perforated portion 312 is provided to the center of the conduction member 310.

Alternatively, the conduction member 310 can be provided outside a range of heating the burner mat 320, which is not shown in the drawings. This is to prevent heating deviation of the burner mat 320. In this case, the heating deviation may take place because a peripheral portion of the burner mat 320 in the vicinity of the conduction member 310 receives more heat from the conduction member 310 than another portion of the burner mat 320, i.e., a central portion.

Alternatively, the conduction member can be configured with a wire shape instead of a plate shape, which is not shown in the drawings. In particular, the conduction member is formed of a heating wire including Ni—Cr alloy to have a length in a radial direction of the burner mat 320.

An operation of the above-configured gas radiation burner according to the fourth embodiment of the present invention is explained as follows. First of all, a mixed gas introduced into the burner pot 220 via the mixing pipe 201 is belched via the burner mat 320. Simultaneously, the mixed gas is ignited by ignition means (not shown in the drawings) to be burnt on a surface of the burner mat 320.

In this case, since the conduction member 310 is provided over the burner mat 320, the quick heating of the burner mat 320 accelerates the combustion of the mixed gas on the surface of the burner mat 320, thereby forming flames on the burner mat 320 stably and enhancing combustion efficiency. As the combustion of the mixed gas is accelerated, the time to heat up the burner mat 320 is reduced, thereby increasing the radiant efficiency. As the combustion of the mixed gas is accelerated, it is able to reduce an amount of carbon monoxide produced from the combustion of the mixed gas. And, it is able to reduce environmental pollution by enhancing properties of an exhaust gas produced from the combustion of the mixed gas.

Accordingly, the present invention provides the following effects or advantages.

First of all, since the mixing pipe is connected to a lateral side of the burner pot, it is possible to reduce the thickness of the gas radiation burner and a compact structure of the gas radiation burner is practicable, as well.

Secondly, since air and gas flow within a mixing pipe to be mixed together, they can be sufficiently mixed to secure a sufficient amount of mixed air for combustion.

Thirdly, air and gas are mixed within a mixing pipe to be supplied to a burner pot and are then injected at a wide exit angle. Therefore, mixed gas distribution within the burner pot is even to enable stable and uniform surface combustion. Hence, combustion efficiency is raised and emitted radiant energy is increased.

Fourthly, it is able to reduce a size of a burner pot. As installation feasibility is enhanced, it is able to reduce an overall size of a gas radiation burner. Hence, it is able to install the gas radiation burner in various places such as a built-in type gas oven or range and the like.

Fifthly, as the combustion accelerating means accelerates combustion of a mixed gas, the time to heat up a burner mat is reduced. Hence, it is able to raise radiant efficiency.

Finally, as the combustion of a mixed gas is accelerated, an amount of carbon monoxide produced from the combustion of the mixed gas. Hence, it is able to reduce environmental pollution by reforming properties of an exhaust gas.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A gas radiation burner comprising:

a gas injection member for injecting a gas;

a plurality of diffusers producing a mixed gas by sucking air together with the gas injected by the gas injection member, the plurality of diffusers uniformly injecting the mixed gas;

a burner pot having a lateral side opening connected to the plurality of diffusers to accommodate the mixed gas supplied by the plurality of diffusers;

a burner mat provided over the burner pot to emit radiant heat generated by combustion of the mixed gas supplied by the burner pot;

a burner housing provided on the burner mat to provide a combustion room;

a plurality of direction adjusting members provided to a connecting portion between a corresponding one of the diffusers and the burner pot to adjust a direction of the mixed gas supplied by the corresponding one of the diffusers, the plurality of direction adjusting members being spaced apart from each other, wherein each direction adjusting member is in a form of a rib; and a plurality of slits, each of the slits being between two immediately adjacent direction adjusting members, wherein the plurality of diffusers have a widening pipe shape, and wherein the mixed gas discharged from one of the plurality of diffusers into the burner pot moves in a radial direction including a direction of a center of the burner pot and is mixed with another mixed gas discharged from another one of the plurality of diffusers in the radial direction, and wherein a width of each slit on a first end of the each slit is narrower than the width of the each slit on a second, opposite end of the each slit, wherein the first end of the each slit immediately faces the corresponding one of the diffusers, and the second, opposite end of the each slit immediately faces the burner pot.

2. The gas radiation burner of claim 1, wherein the plurality of diffusers are integrally formed with the burner pot.

3. The gas radiation burner of claim 1, wherein the plurality of diffusers are detachable from the burner pot.

4. The gas radiation burner of claim 1, wherein the plurality of diffusers include a pair of the diffusers provided to the lateral side opening of the burner pot and another lateral side opening of the burner pot, respectively, the another lateral side opening being opposite to the lateral side opening.

5. The gas radiation burner of claim 1, further comprising a pressure recovering member provided to a connecting portion between the at least one diffuser and the burner pot to recover a pressure of the mixed gas injected by the at least one diffuser.

6. The gas radiation burner of claim 5, wherein the pressure recovering member comprises a mesh.

7. The gas radiation burner of claim 1, wherein the plurality of diffusers are in contact with the burner pot such that two straight lines extending from side outlines of an exit of each of the plurality of diffusers is tangent to an outer circumference of the burner pot.

8. The gas radiation burner of claim 1, wherein the plurality of diffusers are bent.

9. The gas radiation burner of claim 8, wherein the plurality of diffusers are bent by 90 degrees.

10. The gas radiation burner of claim 8, wherein the plurality of diffusers include a pair of the diffusers provided to the lateral side opening of the burner pot and another lateral side opening of the burner pot, respectively, the another lateral side opening being opposite to the lateral side opening.

11. The gas radiation burner of claim 1, further comprising combustion accelerating means for accelerating the combustion on the burner mat.

12. The gas radiation burner of claim 11, the combustion accelerating means comprising a catalyzing agent for catalytic reforming of the mixed gas.

13. The gas radiation burner of claim 12, wherein the catalyzing agent comprises either Ni or Pt.

14. The gas radiation burner of claim 12, wherein the burner mat is made of the catalyzing agent.

15. The gas radiation burner of claim 12, wherein the burner mat is coated with the catalyzing agent.

16. The gas radiation burner of claim 12, wherein the burner mat is provided with a plurality of belching holes via which the mixed gas belches out.

17. The gas radiation burner of claim 16, wherein a diffusion portion is provided to an end portion of each of the belching holes.

18. The gas radiation burner of claim 11, wherein the combustion accelerating means includes a conduction member provided over the burner mat with higher thermal conductivity than the burner mat.

19. The gas radiation burner of claim 18, wherein the conduction member comprises a Ni—Cr alloy.

20. The gas radiation burner of claim 18, wherein the conduction member has a shape corresponding to that of the burner mat.

21. The gas radiation burner of claim 20, wherein a perforated portion is provided to the conduction member to prevent overheating of the burner mat.

22. The gas radiation burner of claim 21, wherein the conduction member includes a wire.

* * * * *